US011192694B1

(12) United States Patent
Dautorio

(10) Patent No.: US 11,192,694 B1
(45) Date of Patent: Dec. 7, 2021

(54) BAG STORAGE ASSEMBLY

(71) Applicant: Albert V. Dautorio, Kissimmee, FL (US)

(72) Inventor: Albert V. Dautorio, Kissimmee, FL (US)

( * ) Notice: Subject to any disclaimer, the term of this patent is extended or adjusted under 35 U.S.C. 154(b) by 0 days.

(21) Appl. No.: 17/005,255

(22) Filed: Aug. 27, 2020

(51) Int. Cl.
*B65D 33/14* (2006.01)
*A47G 29/08* (2006.01)

(52) U.S. Cl.
CPC ..... *B65D 33/14* (2013.01); *A47G 29/08* (2013.01)

(58) Field of Classification Search
CPC ..... B65D 33/14; B65D 33/06; A47G 29/08; A47G 29/083; A47G 29/00; A47G 29/093; B65F 1/00
USPC .... 248/95, 99, 100, 101, 317, 339, 340, 341
See application file for complete search history.

(56) References Cited

U.S. PATENT DOCUMENTS 3,378,180 A * 4/1968 Singer ..... A47G 25/743 223/87
3,592,343 A * 7/1971 Swett ..... A47G 25/743 211/123
4,282,911 A * 8/1981 Sumitomo ..... A45C 15/00 223/88
4,638,968 A * 1/1987 Auten ..... B65B 67/12 248/100
4,798,293 A * 1/1989 Carstens ..... B65D 85/182 206/292
4,841,596 A 6/1989 Fink
4,884,603 A * 12/1989 Simpson ..... B65B 67/1238 141/390
5,042,687 A 8/1991 McKinley
5,094,414 A * 3/1992 Eddy, Jr. ..... B65D 33/14 211/113
5,222,638 A * 6/1993 Kolton ..... A47G 25/743 223/85
5,244,175 A * 9/1993 Frankel ..... A47G 23/0225 211/113
5,285,927 A 2/1994 Pruitt
(Continued)

OTHER PUBLICATIONS

SimpleHuman Wall Mount Grocery Bag Holder, Amazon.com, https://www.amazon.com/simplehuman-Grocery-Holder-Brushed-Stainless/dp/B0001XRNDI [date accessed: May 4, 2020].

*Primary Examiner* — Nkeisha Smith
(74) *Attorney, Agent, or Firm* — Houda El-Jarrah; Bold IP, PLLC

(57) ABSTRACT

A storage assembly for storing recyclable plastic shopping bags is provided. The storage assembly includes a bag flattening structure that when placed within the inner volume of a plastic bag holds the bag fully extended and flat. The assembly also includes a bag handle structure positioned generally above the bag flattening structure adapted to hold the top handles of the bag taut. A plurality of plastic bags may be placed onto the bag storage assembly, with each bag placed within the inner volume of the next. The storage assembly also includes an attachment mechanism (e.g., a top hook) so that the assembly may be hung upright for storage. The assembly may be formed of recyclable plastic itself so that it too may be recycled when the stored bags are deposited to a recycling facility or drop-off bin. In this way, the recyclable bags and the bag holder may be dropped off together as a unit. The bag storage assembly may be adapted to hold up to 50 or more recyclable plastic shopping bags.

18 Claims, 9 Drawing Sheets

(56) References Cited

U.S. PATENT DOCUMENTS 5,344,109 A * 9/1994 Hokoana, Jr. ..... B65F 1/1415 248/100
5,413,301 A * 5/1995 Cadman ..... B65D 73/0071 211/113
5,496,087 A * 3/1996 Lathrop ..... B65B 43/14 248/95
5,615,810 A * 4/1997 Kolton ..... A47G 25/743 223/85
5,620,118 A * 4/1997 Kolton ..... A47G 25/743 223/85
5,639,051 A * 6/1997 Surbeck ..... B65B 67/1216 248/100
5,921,601 A * 7/1999 Buckles ..... B65D 33/14 24/30.5 R
6,012,843 A 1/2000 Brooks et al.
6,202,718 B1 * 3/2001 Innocenti ..... B65D 71/30 141/391
6,390,422 B2 * 5/2002 Banko ..... B62B 9/26 211/113
6,398,086 B1 * 6/2002 Bennett ..... A47F 7/12 211/113
6,651,941 B1 * 11/2003 Kinsel ..... A45F 5/1026 248/100
6,863,249 B1 * 3/2005 Alvord ..... B60R 9/02 248/208
7,380,667 B2 * 6/2008 Divine ..... B65D 33/001 206/554
7,775,491 B1 * 8/2010 Samu ..... G10G 5/00 248/215
8,157,224 B2 * 4/2012 Turvey ..... B65D 33/14 248/95
8,240,465 B2 * 8/2012 Bennett ..... A47G 25/54 206/287
8,777,069 B2 * 7/2014 Lewis ..... A47G 25/14 223/88
9,585,496 B2 * 3/2017 Strassburger ..... A47F 7/02
9,694,840 B2 * 7/2017 Hendrick ..... B62B 3/1464
9,756,917 B2 * 9/2017 Zech ..... A45C 13/002
10,507,859 B2 * 12/2019 Bacallao ..... B62B 3/106
10,822,144 B2 * 11/2020 Mayer ..... B65F 1/0013
2001/0022333 A1 * 9/2001 Banko ..... B62J 11/00 248/100
2002/0145086 A1 * 10/2002 Alvarado ..... B65B 43/14 248/95
2003/0019980 A1 1/2003 Licari
2006/0013512 A1 * 1/2006 Shaw ..... B65D 33/34 383/5
2006/0213937 A1 * 9/2006 Fife ..... A47G 25/50 223/85
2010/0051655 A1 * 3/2010 Gouldson ..... A47G 25/18 223/91
2010/0254632 A1 * 10/2010 Schneider ..... B65D 33/14 383/11
2010/0264101 A1 * 10/2010 Ma ..... A47G 29/083 211/85.15
2011/0147545 A1 * 6/2011 Faraone ..... B65B 67/1233 248/99
2012/0074181 A1 * 3/2012 Reid ..... A47G 25/10 223/85
2016/0095404 A1 * 4/2016 Zech ..... A45C 13/002 383/15
2016/0227969 A1 * 8/2016 Morris ..... A47K 10/22
2017/0172319 A1 * 6/2017 Giles-Spencer ..... A47G 29/08
2018/0093690 A1 * 4/2018 Bacallao ..... B62B 3/146

* cited by examiner

BAG STORAGE ASSEMBLY

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to storage assemblies, including assemblies adapted to store used plastic shopping bags.

BACKGROUND

According to the Environmental Protection Agency, the U.S. population uses over 100 billion single-use plastic shopping bags per year, with only one plastic bag out of 200 being recycled. An average family accumulates up to 60 plastic bags in only four trips to the grocery store. And while many families store these bags at home with intentions of returning them to the store to be recycled, the bags typically end up wadded-up and taking up space within drawers, kitchen cabinets or in other areas about the home.

In addition, plastic bags are known to be quite aerodynamic, and as such, create significant "flyaway" issues at landfills. This allows the bags to escape the landfills and reenter the environment, causing adverse effects to natural habitats and marine life. Primarily made from fossil fuels with inadequate biodegradability, these plastic bags become permanent features to the landscapes they litter.

Also, it is widely known that recyclable plastic bags cannot be placed into standard curbside recycling bins for recycling, but instead, the bags must be returned directly to a grocery store. Furthermore, plastic bag recyclers will only accept clean, dry, and uncontaminated bags.

Accordingly, there is a need for a bag storage assembly that is easy to use, that holds a plurality of recyclable plastic shopping bags in a single location, and that holds the bags flat to minimize the necessary storage space for the bags. There also is a need for a bag storage assembly that keeps the bags clean and free of contamination so that the bags may be accepted by recycling facilities. There also is a need for a bag storage assembly that secures the bags and weighs them down to avoid flyaway issues.

SUMMARY

According to one aspect, one or more embodiments are provided below for a bag storage assembly (also referred to as a bag holder or simply a holder). The bag holder may include a frame and an attachment mechanism connected to the frame and adapted to attach the holder to a separate apparatus (e.g., to the back of a door or cabinet). The holder also may include a bag handle holder attached to the frame and adapted to hold at least one handle of at least one bag, and a bag body flattener attached to the frame and adapted to be received into an inner volume of the at least one bag. In use, the bag body flattener is received into the inner volume of the at least one bag when the at least one handle of the at least one bag is held by the bag handle holder.

In another embodiment, the frame includes an elongated member with a top end and a bottom end, and the attachment mechanism is attached to the elongated member's top end, the bag body flattener is attached to the elongated member's bottom end, and the bag handle holder is attached to the elongated member at an intermediary position between the top end and the bottom end.

In another embodiment, the attachment mechanism includes at least one of a hook, a loop, and a clamp.

In another embodiment, the bag handle holder includes a crossbar including a crossbar left end and a crossbar right end.

In another embodiment, the bag handle holder includes a first handle stop coupled to the crossbar left end and adapted to hold a first at least one handle of the at least one bag, and a second handle stop coupled to the crossbar right end and adapted to hold a second at least one handle of the at least one bag.

In another embodiment, the first handle stop is configured to transition from a first handle stop upper position that holds the first at least one handle to a first handle stop lower position that releases the first at least one handle, and the second handle stop is configured to transition from a second handle stop upper position that holds the second at least one handle to a second handle stop lower position that releases the second at least one handle.

In another embodiment, the at least one bag includes a bag width and the bag body flattener includes a bag body flattener width that is equal to or less than the bag width and greater than half the bag width.

In another embodiment, the bag body flattener width includes a middle point and the frame is attached to the bag body flattener at a position to the left or to the right of the middle point.

In another embodiment, the bag body flattener includes a first portion attached to the frame and a second portion attached to the first portion and positioned below the first portion.

In another embodiment, the first portion is formed as an inverted triangle with a downward pointing apex, the second portion is formed as an upright triangle with an upward pointing apex, and the downward pointing apex of the first portion is attached to the upward pointing apex of the second portion.

In another embodiment, the first portion includes a first portion left side and a first portion right side and the second portion includes a second portion left side and a second portion right side, and the first portion left side is aligned with the second portion left side and/or the first portion right side is aligned with the second portion right side.

In another embodiment, the first portion includes a first portion width and the second portion includes a second portion width, and the first portion width is greater than the second portion width.

In another embodiment, the first portion includes a first portion left side and a first portion right side and the second portion includes a second portion left side and a second portion right side, and the first portion left side is aligned with the second portion left side or the first portion right side is aligned with the second portion right side.

According to another aspect, the present description includes a bag storage assembly (also referred to as a bag holder or simply a holder) that may include an elongated member with a top end and a bottom end, and a hook, loop or clamp connected to the top end of the elongated member and adapted to attach the holder to a separate apparatus. The bag holder may also include a crossbar with a crossbar left end and a crossbar right end and attached to the elongated member at a position between the elongated member's top end and bottom end and adapted to hold at least one handle of at least one bag; and a bag body flattener attached to the bottom end of the elongated member and adapted to be received into an inner volume of the at least one bag. In use, the bag body flattener is received into the inner volume of the at least one bag when the at least one handle of the at least one bag is held by the bag handle holder.

In another embodiment, the crossbar includes a first handle stop coupled to the crossbar left end and adapted to hold a first at least one handle of the at least one bag, and a second handle stop coupled to the crossbar right end and adapted to hold a second at least one handle of the at least one bag.

In another embodiment, the first handle stop is configured to transition from a first handle stop upper position that holds the first at least one handle to a first handle stop lower position that releases the first at least one handle, and the second handle stop is configured to transition from a second handle stop upper position that holds the second at least one handle to a second handle stop lower position that releases the second at least one handle.

In another embodiment, the at least one bag includes a bag width and the bag body flattener includes a bag body flattener width that is equal to or less than the bag width and greater than half the bag width.

In another embodiment, the bag body flattener width includes a middle point and the frame is attached to the bag body flattener at a position to the left or to the right of the middle point.

In another embodiment, the bag body flattener includes a first portion attached to the elongated member and a second portion attached to the first portion and positioned below the first portion.

In another embodiment, the first portion includes a first portion width between a first portion left side and a first portion right side and the second portion includes a second portion width between a second portion left side and a second portion right side, wherein the first portion width is greater than the second portion width and wherein the first portion left side is aligned with the second portion left side or the first portion right side is aligned with the second portion right side.

Other aspects and advantages of the invention will be apparent from the following description and the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the bag storage assembly according to exemplary embodiments hereof includes a bag storage assembly for securing a plurality of standard recyclable plastic shopping bags. In some embodiments, the bag storage assembly holds the bags flat, with each bag held within the inner volume of the next consecutive bag. In this way, the bag storage assembly may secure and hold flat a multitude of recyclable shopping bags. In some embodiments, the bag storage assembly may be hung on a hook (e.g., on the back of a door) or other structure for safe keeping. The bags and the bag storage assembly may then be taken to a recycling drop off bin and deposited to be recycled.

Figure 1:
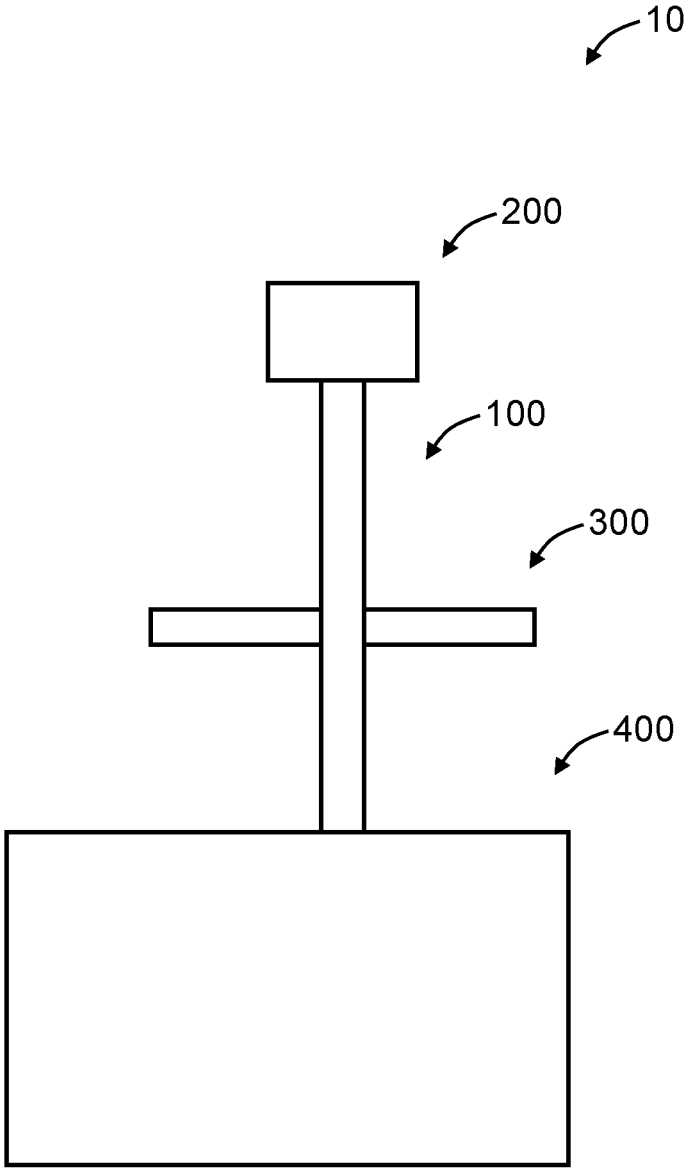
FIG. 1 shows aspects of a bag storage assembly according to exemplary embodiments hereof.
Figure 2:
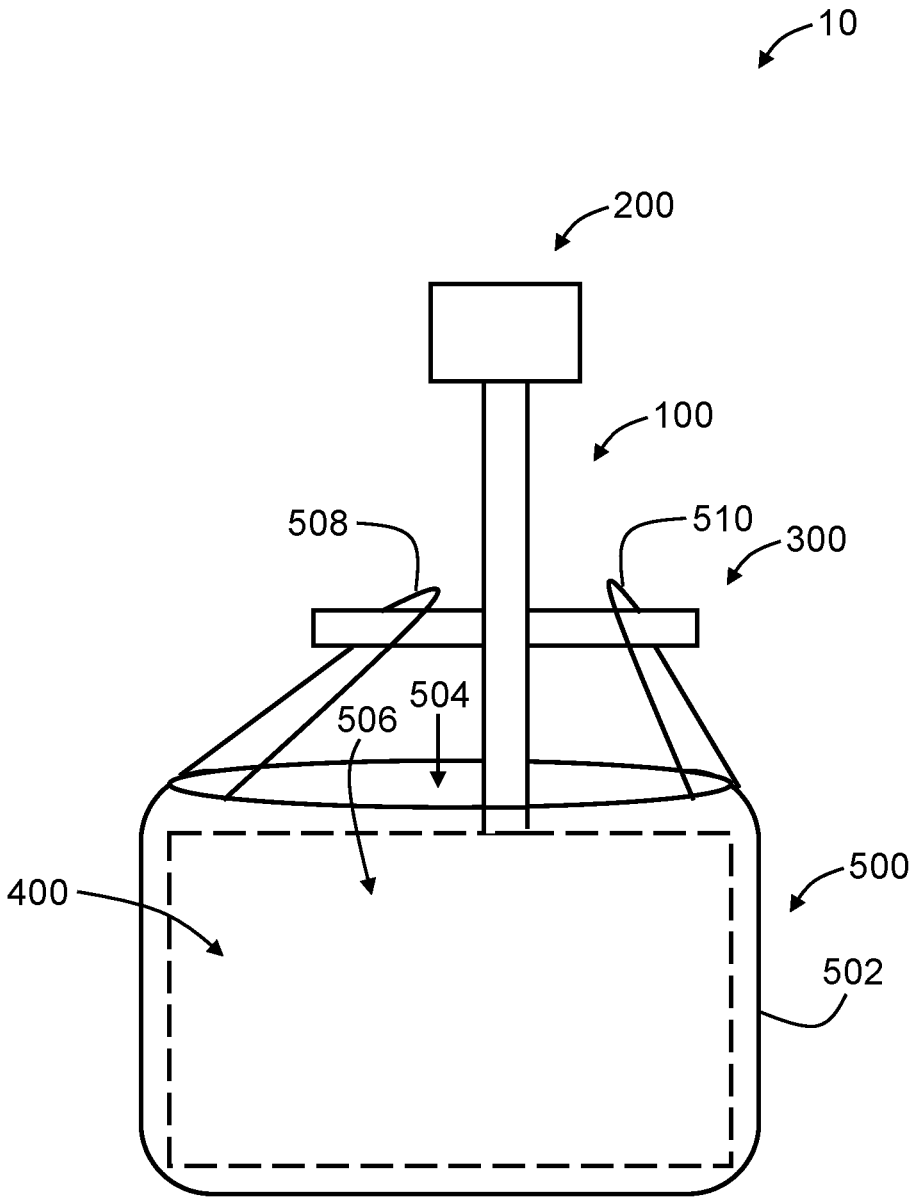
FIG. 2 shows aspects of a bag storage assembly holding a bag according to exemplary embodiments hereof.

In one exemplary embodiment hereof, as shown in FIGS. 1 and 2, the bag storage assembly 10 includes a frame assembly 100, an attachment assembly 200, a bag handle holding assembly 300, and a bag body flattening assembly 400. FIG. 1 shows the bag storage assembly 10 alone, and FIG. 2 shows the bag storage assembly 10 configured with a plastic shopping bag 500 for storage. In general, the bag storage assembly 10 secures and holds flat one or more plastic shopping bags 500 for easy space-saving storage and recycling. Note that the assemblies 100, 200, 300, 400 are depicted as blocks to represent the general configuration of the assemblies 100, 200, 300, 400 with respect to one another, and that the representations do not necessarily represent the size, shape or form of the various assemblies 100, 200, 300, 400. These details will be described in other sections.

For the purposes of this specification, the bag storage assembly 10 will be described primarily with use in holding and storing recyclable plastic shopping bags 500 typically provided by grocery stores for carrying purchased grocery items (FIG. 2). As is known in the art, these bags 500 may include a bag body 502 with a top opening 504 and in inner volume 506. The bags 500 also may include a right top bag handle 508 and a left top bag handle 510 for holding the bag 500. It is understood however that the bag storage assembly 10 may be used with other types of bags, as well as other types of items, that may benefit from the assembly 10, and that the scope of the assembly 10 is not limited in any way by the type of bag(s) or other item(s) that it may be used with.

In general, the frame assembly 100 provides a support structure for the attachment assembly 200, the bag handle holding assembly 300 and the bag body flattening assemble 400. The attachment assembly 200 facilitates the attachment of the bag storage assembly 10 to another structure (e.g., onto a hook on the back of a door), the bag handle holding assembly 300 holds the handles of the bag 500 upright, and the bag body flattening assembly 400 fits within the bag's inner volume 506 to hold the bag 500 generally flat. The assembly 10 also may include other components and elements as necessary for the assembly 10 to perform its functionalities.

In some embodiments, it may be preferable that the bag storage assembly 10 and its various assemblies 100, 200, 300, 400 comprise recyclable materials such as, but not limited to, polyethylene films (including high-density polyethylene (HDPE or #2 plastic) and/or low-density polyethylene (#4 plastic or LDPE)). Other recyclable materials also may be used. In this way, when the stored bags 500 are returned to a facility (or a drop off location) to be recycled, the bag storage assembly 10 also may be included in the drop off thereby eliminating the need to remove the bags 500 from the assembly 10.

Frame Assembly 100

Figure 3:
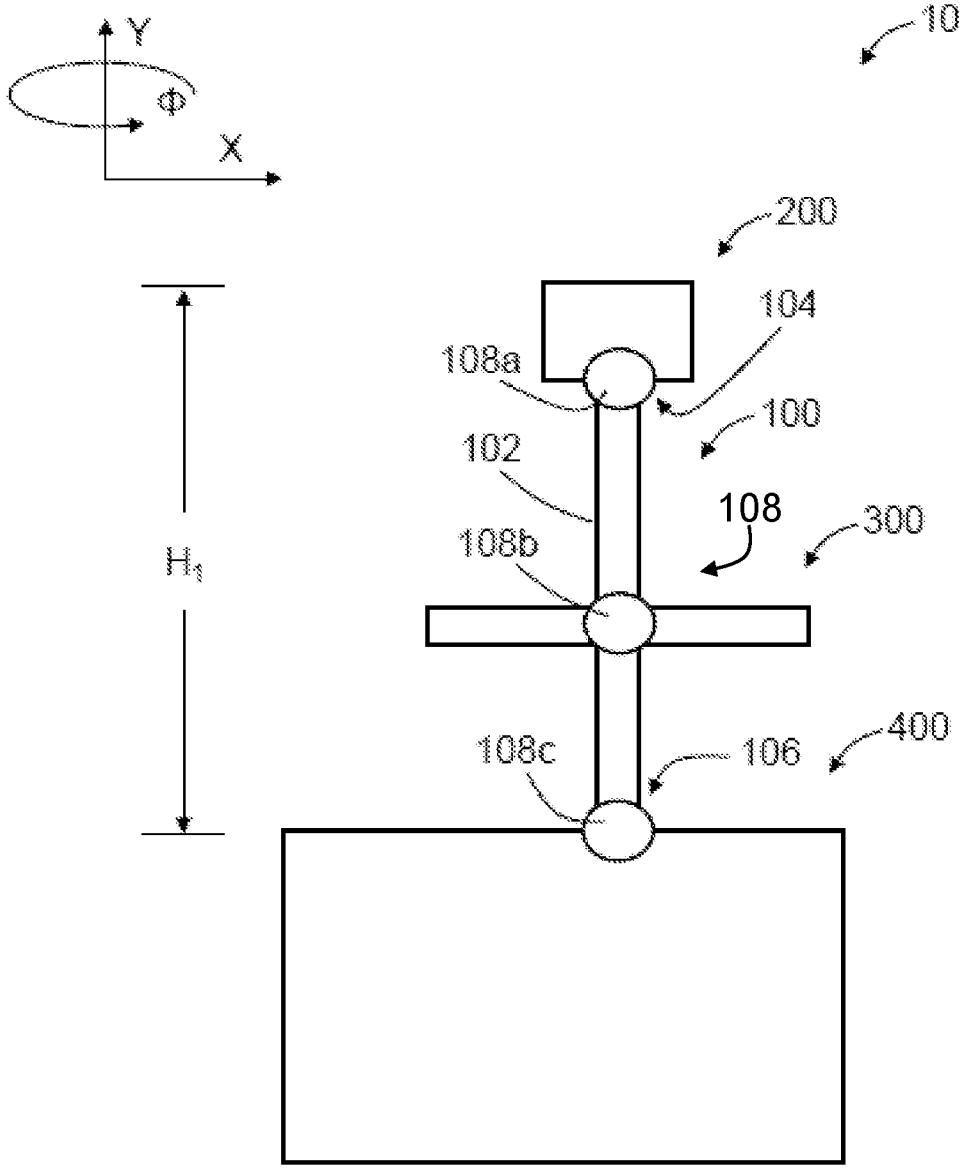
FIG. 3 shows aspects of a bag storage assembly elongated member according to exemplary embodiments hereof.

In one exemplary embodiment hereof as shown in FIG. 3, the frame assembly 100 includes an elongated member 102 such as a rod, a bar, a pole, a shaft, a dowel, a post, a beam, any other type of elongated member and any combination thereof. The elongated member 102 may be generally oriented upright along the Y-axis with a top 104 and a bottom 106. In some embodiments, the elongated member 102 may comprise plastic, metal, composite materials, other types of suitable materials and any combination thereof.

In some embodiments, the frame assembly 100 includes one or more attachment mechanisms 108 adapted to connect the other assemblies 200, 300, 400 to the frame assembly 100. For example, the frame assembly 100 may include a first attachment mechanism 108*a* generally located at its top 104 and adapted to connect the attachment assembly 200 thereto. The frame assembly also may include a second attachment mechanism 108*b* positioned at an intermediary location between its top 104 and bottom 106 and adapted to connect the bag handle holding assembly 300 thereto, and a third attachment mechanism 108*c* generally located at its bottom 106 and adapted to connect the bag body flattening assembly 400 thereto.

In some embodiments, the attachment mechanisms 108 may include fixed attachment mechanisms 108 that fixedly secure the assemblies 200, 300, 400 to the elongated member 102. In other embodiments, the attachment mechanisms 108 may include rotatable attachment mechanisms 108 that enable the assemblies 200, 300, 400 to rotate about the Y-axis relative to the elongated member 102 (as represented by F). To accomplish this, in some embodiments, the rotatable attachment mechanisms 108 may include any type of rotatable mechanisms as known in the art such as ball joints, interlaid concentric tubing, rotatable bolts, other types of rotatable mechanisms and any combination thereof.

In any event, it is preferable that the attachment mechanisms 108 securely attach the assemblies 200, 300, 400 to the frame assembly 100 with enough strength to withstand the forces applied to the various assemblies 200, 300, 400 and/or to the overall assembly 10 during use.

In some embodiments, the elongated member 102 may include a height H1 of about 2' to about 3', and a diameter of about 0.25" to about 1". However, it is understood that other dimensions also may be used as appropriate.

Attachment Assembly 200

In one exemplary embodiment hereof, the attachment assembly 200 includes an attachment element 202 (also referred to as an attachment mechanism 202) adapted to attach the bag storage assembly 10 to another structure such as, without limitation, a hook on the back of a door, a door knob, a nail or screw protruding from a wall or cabinet, any other type of structure and any combination thereof.

In some embodiments, the attachment element 202 is connected at or towards the top 104 of the frame assembly's elongated member 102 (e.g., using the attachment mechanism 108*a* as described above). However, the attachment assembly 200 also may be connected to the elongated member 102 at other locations.

Figure 4A:
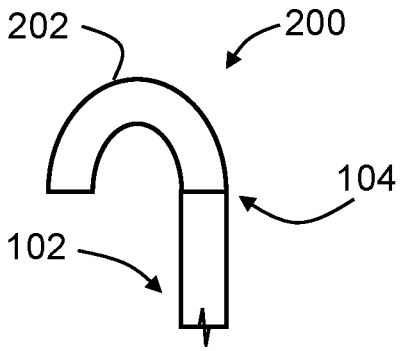
FIGS. 4A-4C show aspects of a bag storage assembly attachment mechanism according to exemplary embodiments hereof.
Figure 4B:
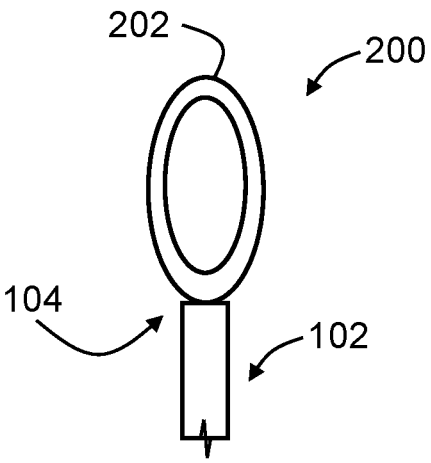
Figure 4C:
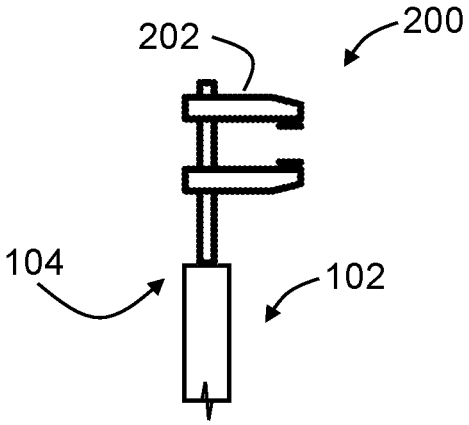

In some embodiments, it may be preferable that the attachment element 202 be removably attachable to the supporting structure (door hook) so that it may be removed and replaced as necessary during use. For example, as shown in FIGS. 4A-4C, the attachment element 202 may include a hook (FIG. 4A), a loop (FIG. 4B), a clamp (FIG. 4C), and/or other types of attachment elements 202. In this way, a user may remove the assembly 10 to add shopping bags 500 to the assembly 10 for safe keeping, and then subsequently replace the assembly for storage. However, it is understood that fixed attachment elements 202 such as screws also may be used.

It is understood that the attachment elements 202 depicted in FIG. 4A-4C are meant for demonstration and that other types of attachment elements 202 (such as hook and loop material, double-sided tape, adhesive, etc.) also may be used depending on the installation and application of the assembly 10. It is also understood that the scope of the attachment assembly 200 and of the overall assembly 10 is not limited in any way by the type(s) of attachment elements 202 employed.

Bag Handle Holding Assembly 300

Figure 5:
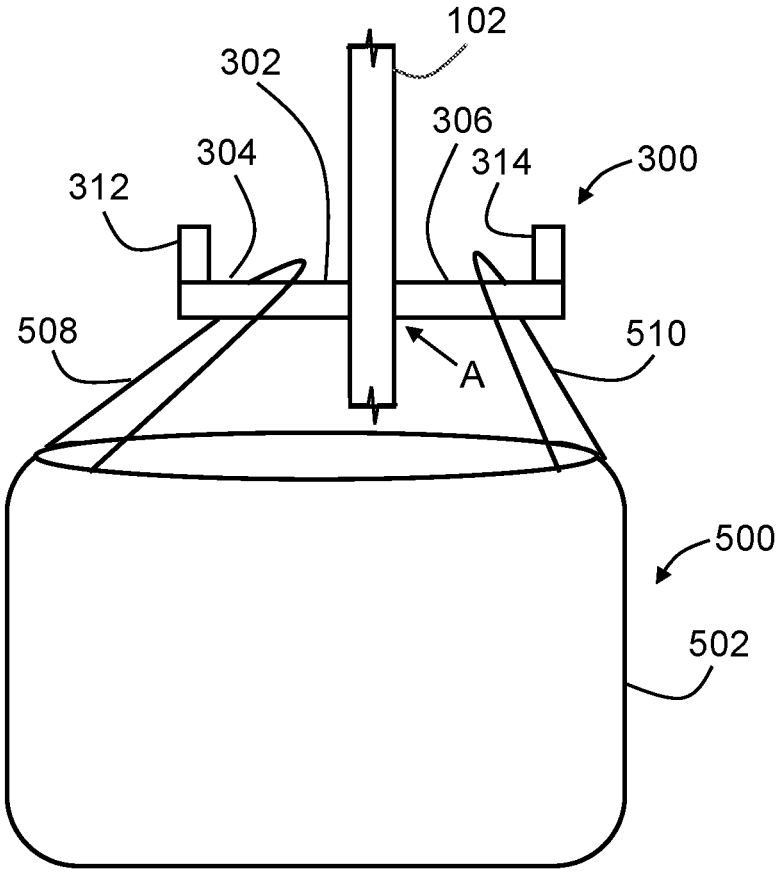
FIG. 5 show aspects of a bag storage assembly bag handle holder according to exemplary embodiments hereof.

In one exemplary embodiment hereof as shown in FIG. 5, the bag handle holding assembly 300 (also referred to as a bag handle holder 300) includes a crossbar 302 with a left portion 304 and a right portion 306 attached to the frame assembly's elongated member 102 (e.g., using the attachment mechanism 108*b*). In some embodiments, the crossbar 302 is oriented generally perpendicular to the elongated member 102 and attached to the elongated member 102 at an intermediary location A between the elongated member's top 104 and bottom 106. In this way, the crossbar's left portion 304 and right portion 306 may each extend outward from the elongated member 102 in opposite directions.

In some embodiments, the crossbar 302 is adapted to hold the left and right handles 508, 510 of the shopping bag 500 so that the body 502 of the bag 500 may generally hang down below the crossbar 302. For example, as shown in FIG. 5, the crossbar's left portion 304 may be adapted to hold the bag's left handle 508, and the crossbar's right portion 306 may be adapted to hold the bag's right handle 510.

Additionally, in some embodiments, the left portion 304*a* may include a left stop 312 and the right portion 306 may include a right stop 314. With the bag's handles 508, 510 looped through the left and right crossbar portions 304, 306, respectively, the left stop 312 may prevent the left bag handle 508 from slipping off the crossbar's left portion 304, and the right stop 314 may prevent the right bag handle 510 from slipping off the crossbar's right portion 306. While the left and right stops 312, 314 are depicted in FIG. 5 as upright bars, the left and right stops 312, 314 may comprise any shape or form that may prevent the bag handles from slipping off their respective crossbar portions 304, 306. For example, the left and right stops 312, 314 may be formed as hooks, angled rods, other types of forms and any combination thereof.

In some embodiments, the crossbar 302 may include curvatures that may prevent the bag handles 508, 510 from slipping off their respective crossbar portions 304, 306. For example, the crossbar 302 may include a "U" shaped or "V" shaped curvature integrated into the left and/or right portions 304, 306, or types of suitable curvatures, that may be adapted to hold the bag handles 508, 510 in place while preventing them from slipping off the crossbar portions 304, 306. In these embodiments, the stops 312, 314 may or may not be required.

Bag Body Flattening Assembly 400

Figure 6:
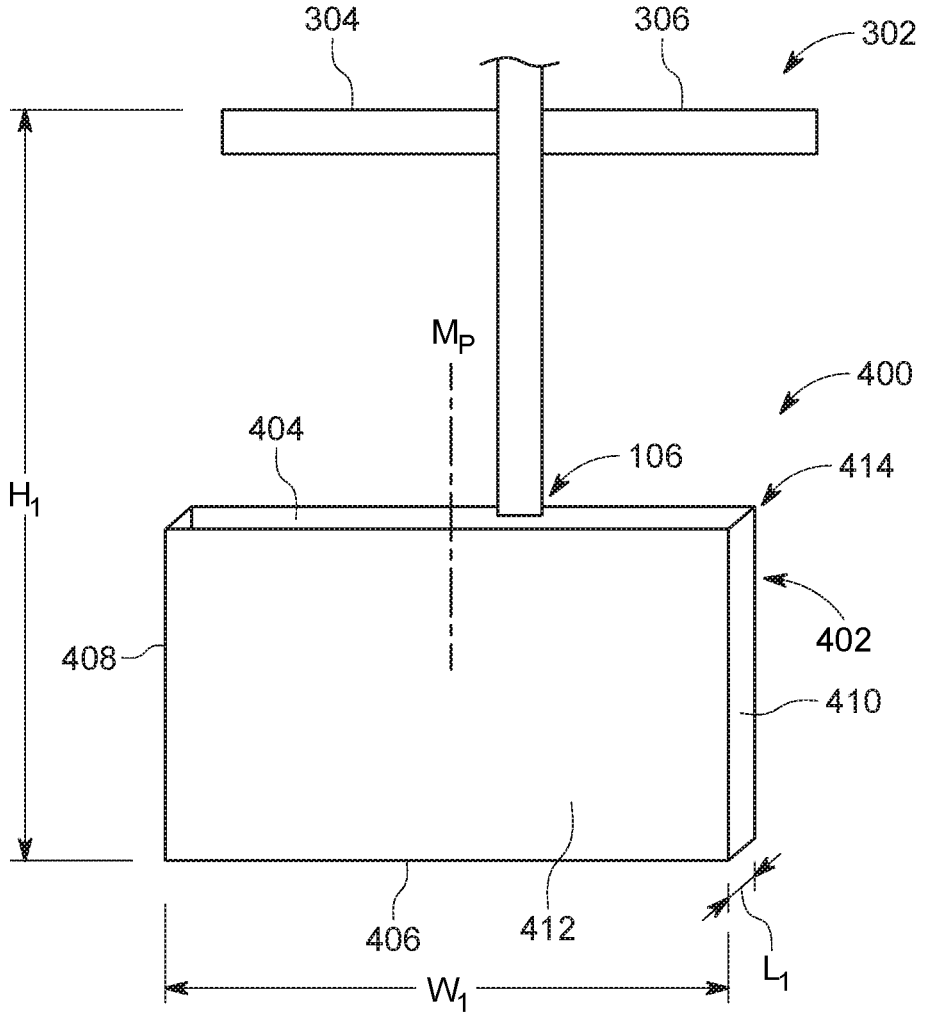
FIG. 6 shows aspects of a bag storage assembly bag flattening structure according to exemplary embodiments hereof.

In one exemplary embodiment hereof as shown in FIG. 6, the bag body flattening assembly 400 (also referred to as a bag body flattener 400) includes a bag flattening structure 402 attached at or towards the bottom 106 of the frame assembly's elongated member 102 (e.g., using the attachment mechanism 108*c*). However, the bag flattening structure 402 also may be connected to the elongated member 102 at other locations.

In some embodiments, the bag flattening structure 402 may include a top 404, a bottom 406, a left side 408, a right side 410, a front 412 and a back 414. FIG. 6 depicts the flattening structure 402 as generally rectangular, but as will be described in other sections, the structure 402 may take other forms and/or combinations of forms.

The bag flattening structure 402 may include a front width $W_1$ that generally matches the internal width of a standard recyclable plastic shopping bag 500, respectively. For the purposes of this specification, the internal width of a standard recyclable plastic shopping bag 500 is generally defined as the width of the bag 500 with the bag 500 laid flat and its left handle positioned to the far left and its right handle positioned to the far right (see FIG. 2).

In some embodiments, it may be preferable that the width $W_1$ be slightly less than the internal width of the recyclable shopping bags 500 so that multiple plastic bags may be placed onto the bag flattening structure 402 at once. In one example, the width $W_1$ may be equal to or less than the internal width of the bag 500 and greater than half the width of the bag 500. In another example, the width $W_1$ may be equal to or less than the internal width of the bag 500 and greater than 55%, 60%, 65%, 70%, 75%, 80%, 85%, 90% or 90% of the width of the bag 500.

In some embodiments, the length $L_1$ of the bag flattening structure 402 may be chosen to enable the bag flattening structure 402 to be inserted into the inner volume 506 of a plastic shopping bag 500. For example, the length L1 of the bag flattening structure 402 may be about 0.25" to about 2".

In some embodiments, the distance $H_1$ between the top of the crossbar 302 and the bottom 406 of the bag flattening structure 402 may be chosen to generally match the distance between a plastic bag's top handle and the bag's bottom with the bag in a fully extended and flattened positioning. In this way, when the flattening structure 402 is placed within a bag's inner volume 506, and the bag's handles 508, 510 are placed over the left and right crossbar portions 304, 306, respectively, the bag 500 is held in a generally fully extended position with the handles generally taut.

In other embodiments, the bag flattening structure 402 may be formed as other shapes such as, without limitation, trapezoidal, circular, oval, square, other types of shapes and any combinations thereof. Other shaped bag flattening structures 402 will be described in other sections.

In some embodiments, the bag flattening structure 402 may be hollow, solid and/or may be formed using other elements and structures as will be described below.

In some embodiments, the bottom 106 of the elongated member 102 may be connected to the top of the bag flattening structure 402 at a position offset from the structure's width midpoint $M_P$ (e.g., to the left or to the right of the midpoint $M_P$). As will be explained in other sections, this may facilitate the placing of the bag flattening structure 402 into the inner volume 506 of a bag 500. It is understood however that the elongated member 102 also may be connected to the top of the bag flattening structure 402 at the structure's width midpoint $M_P$.

In some embodiments, the position A of the crossbar 302 and the distance between the crossbar 302 and the bag flattening structure 402 is chosen so that when bag handles 508, 510 are placed over left and right crossbar portions 304, 306, that the bag handles 508, 510 are generally taut.

Exemplary Embodiments

Figure 7:
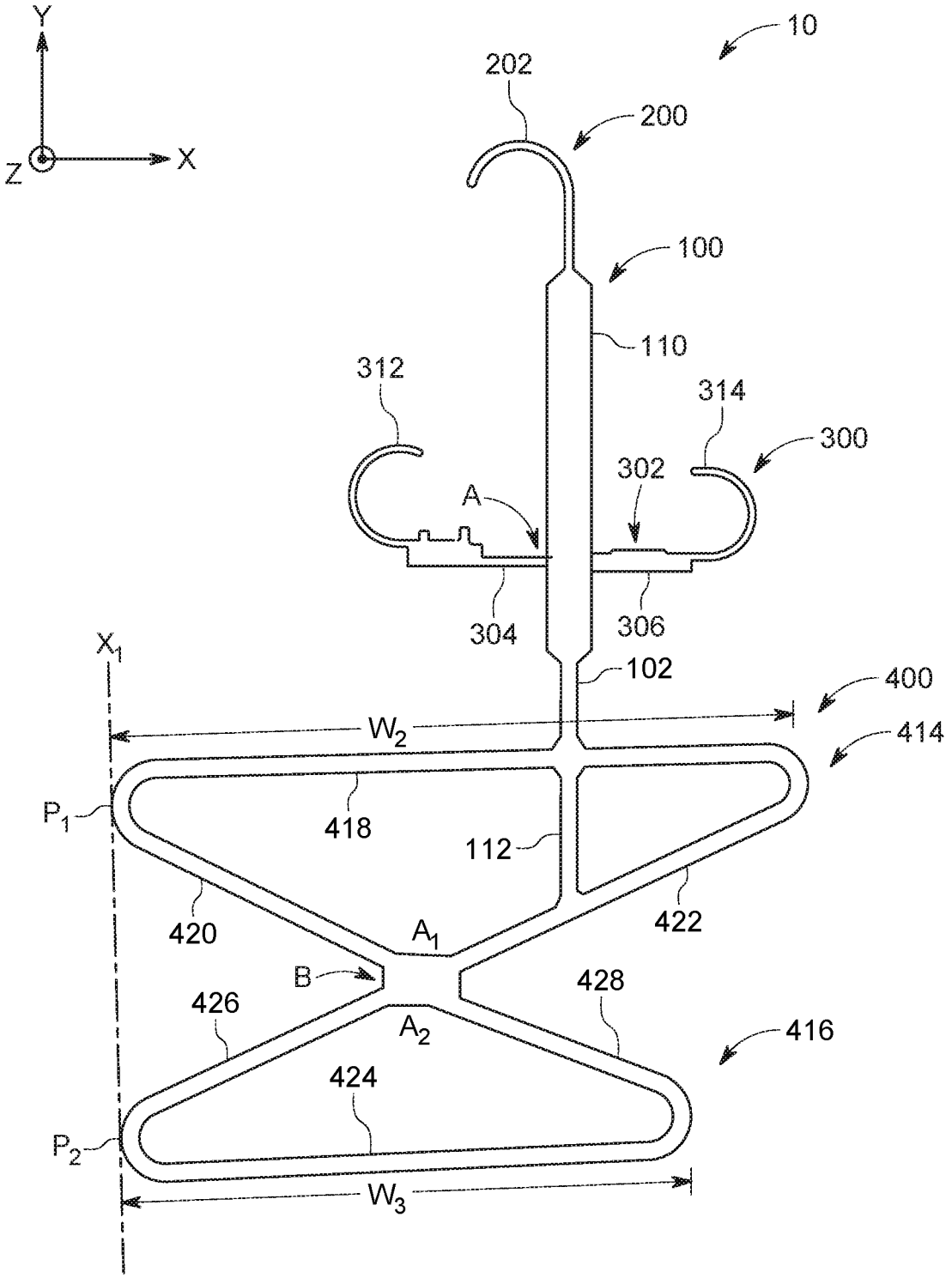
FIG. 7 shows aspects of a bag storage assembly according to exemplary embodiments hereof.

In one exemplary embodiment hereof as shown in FIG. 7, the bag storage assembly 10 includes a frame assembly 100, an attachment assembly 200, a bag handle holding assembly 300, and a bag body flattening assembly 400. As shown, the elongated member 102 includes a reinforced section 110 to which the attachment assembly 200 and the bag handle holding assembly 300 are attached (e.g., via attachment mechanisms 108*a*, 108*b*, respectively). The reinforced section 110 also may provide a handle of increased diameter of which a user of the assembly may grasp. The bag body flattening assembly 400 is attached to the bottom 106 of the elongated member 102 (e.g., via attachment mechanism 108*c*).

The attachment assembly 200 includes an attachment element 202 in the form of a hook. The bag handle holding assembly 300 includes a crossbar 302 with left and right stops 312, 314, each in the form of a sideways hook attached to the outer ends of the left and right portions 304, 306, respectively.

The bag body flattening structure 402 includes a first portion 414 and a second portion 416, with the first portion 414 positioned above the second portion 416, and the portions 414, 416 joined at point B. The width W2 of the first portion and the width W3 of the second portion are preferably aligned along the same plane (e.g., in the Z-plane)

The first portion 414 includes a generally inverted triangular form (preferably isosceles or near-isosceles) with a base 418 and legs 420, 422, and a downward pointing apex $A_1$. The second portion 406 includes a generally upright triangular form (preferably isosceles or near-isosceles) with a base 424 and legs 426, 428 and an upward pointing apex $A_2$. The first portion's apex $A_1$ and the second portion's apex $A_2$ are fixedly joined at point B, thereby forming the bag body flattening structure 402.

In some implementations, the elongated member 102 is attached to the base of the first portion 414. In some implementations, a section 112 may extend from the junction of the elongated member 102 and the first portion's base to an associated leg of the first portion 414. This section 112 may provide additional support between the elongated member 102 and the first portion 414.

In some implementations, the length of the first portion's base 418 is greater than the length of its legs 420, 422, and the length of the second portion's base 424 is greater than the length of its legs 426, 428. In some implementations, the left and right vertices of the first portion 414 and/or of the second portion 416 are rounded.

In some implementations, the width W2 of the first portion 414 may equal or be wider than the width W3 of the second portion 416. For example, the width W2 may be 100%, 110%, 120%, 130%, 140%, 150%, or other percentages of the width W3.

In some implementations, the furthest left point $P_1$ of the first portion 414 and the furthest left point $P_2$ of the second portion 416 are aligned as shown at $X_1$. It is understood that instead of the furthest left points of the first and second portions 414, 416 being aligned, the furthest right points of the portions 414, 416 may be aligned. It is also understood that the outermost points (left or right) need not necessarily be aligned.

Figure 8:
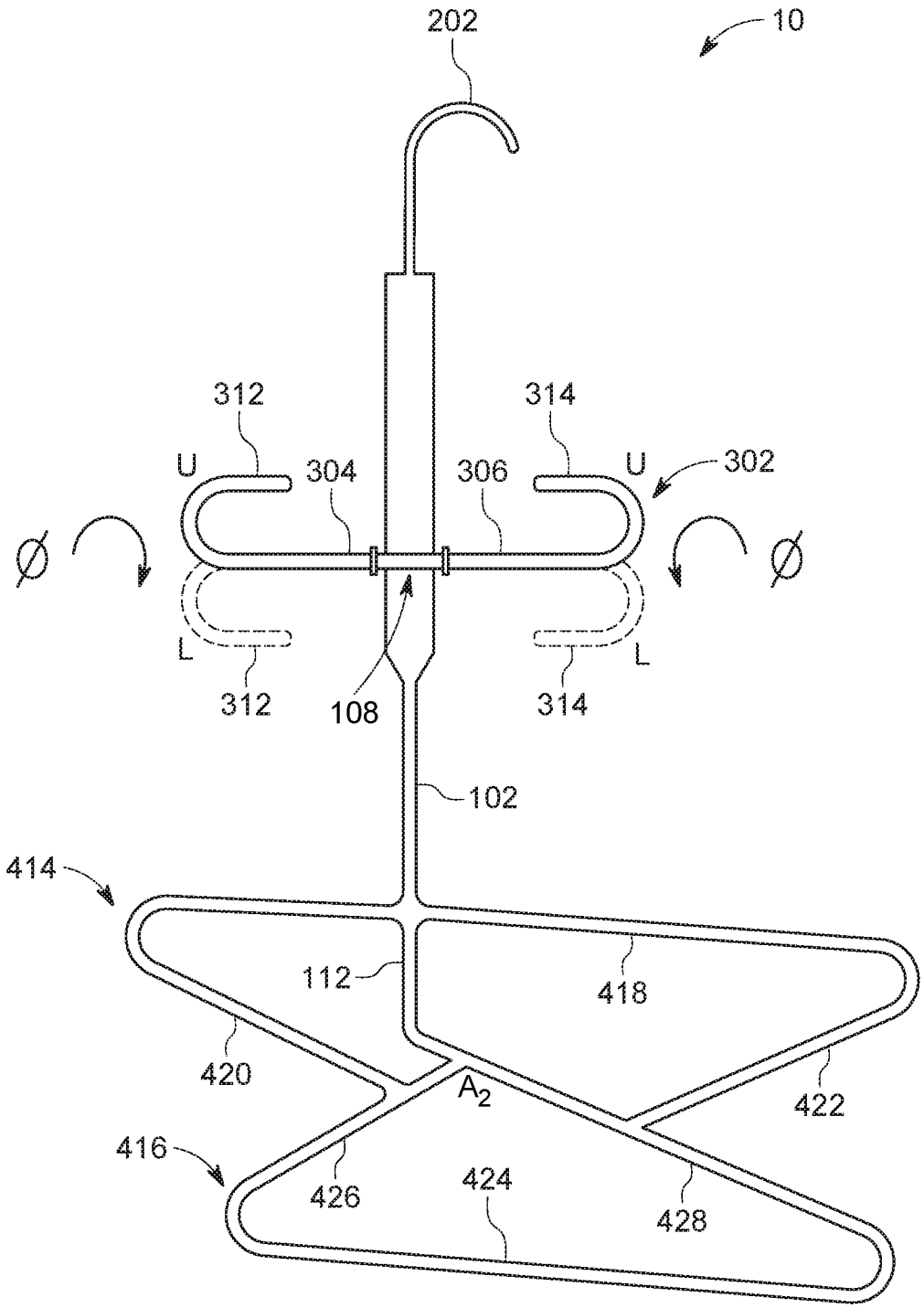
FIG. 8 shows aspects of a bag storage assembly according to exemplary embodiments hereof.

In one exemplary embodiment hereof as shown in FIG. 8, the crossbar 302 is attached to the elongated member 102 using a rotatable attachment mechanism 108 that enables the crossbar to rotate about its longitudinal axis (as defined as an axis extending along the body of the crossbar 302 from its left 304 to its right 306) as depicted by the lines θ. In this way, the crossbar stops 312, 314 may rotate from an upper position U where the bag handles 508, 510 may be held by the stops 312, 314, respectively, to a lower position L where the stops 312, 314 may no longer obstruct the bag handles 508, 510 from sliding off the left and right crossbar portions 304, 306, respectively. Accordingly, when in the upper position U, the stops 312, 314 may secure the handles 508, 510 to the crossbar 302, and when in the lower position L, the handles 508, 510 may be easily removed. This may facilitate the placement of the bags 500 onto the bag storage assembly 10 and any subsequent removal of the bags 500 from the assembly 10. The rotating attachment mechanism 108 may be held in the upright U and/or lower L positions by detents or other holding mechanisms.

In other embodiments, the crossbar stops 312, 314 may be attached to the left and right portions 304, 306, respectively, using attachment mechanisms that enable the stops 312, 314 to rotate downward (e.g., along arrows θ) with respect to the crossbar 302, to flip outwards (away from the elongated member), and/or to move in other ways that may allow for the easy removal of the bag handles 508, 510. In other embodiments, the stops 312, 314 may be removable.

In some embodiments, the bag flattening structure 402 may include other characteristics, forms and/or structures. For example, as shown in FIG. 8, the first and second portions 414, 416 may be joined at different points. In one implementation of this example, the first portion's left leg 420 may be joined with the second portion's left leg 426, and the first portion's right leg 422 may be joined with the second portion's right leg 428. In this example, the first portion's apex $A_1$ may or may not be eliminated beyond the juncture of the legs 420, 426 and 422, 428. It is understood that this example is meant for demonstration and that the first and second portions 414, 416 may be joined at any points and in any orientations.

In some embodiments, the bag flattening structure 402 may be generally perpendicular to the elongated member 102 (FIGS. 6-7) while in other embodiments, the bag flattening structure 402 may be orientated slightly downward and/or upward with respect to the elongated member 102 (e.g., FIG. 8 depicts the flattening structure oriented at a slightly downward angle from left to right).

It is understood by a person of ordinary skill in the art that the bag flattening structure 402 may be formed as any shape and form, as any combinations of any shapes and forms, and at any orientations with respect to the elongated member 102 that may enable the bag flattening structure 402 to perform its functionalities.

In some implementations, the bag storing assembly may be adapted to hold up to 50 or more bags 500 at once.

In Use

Figure 9:
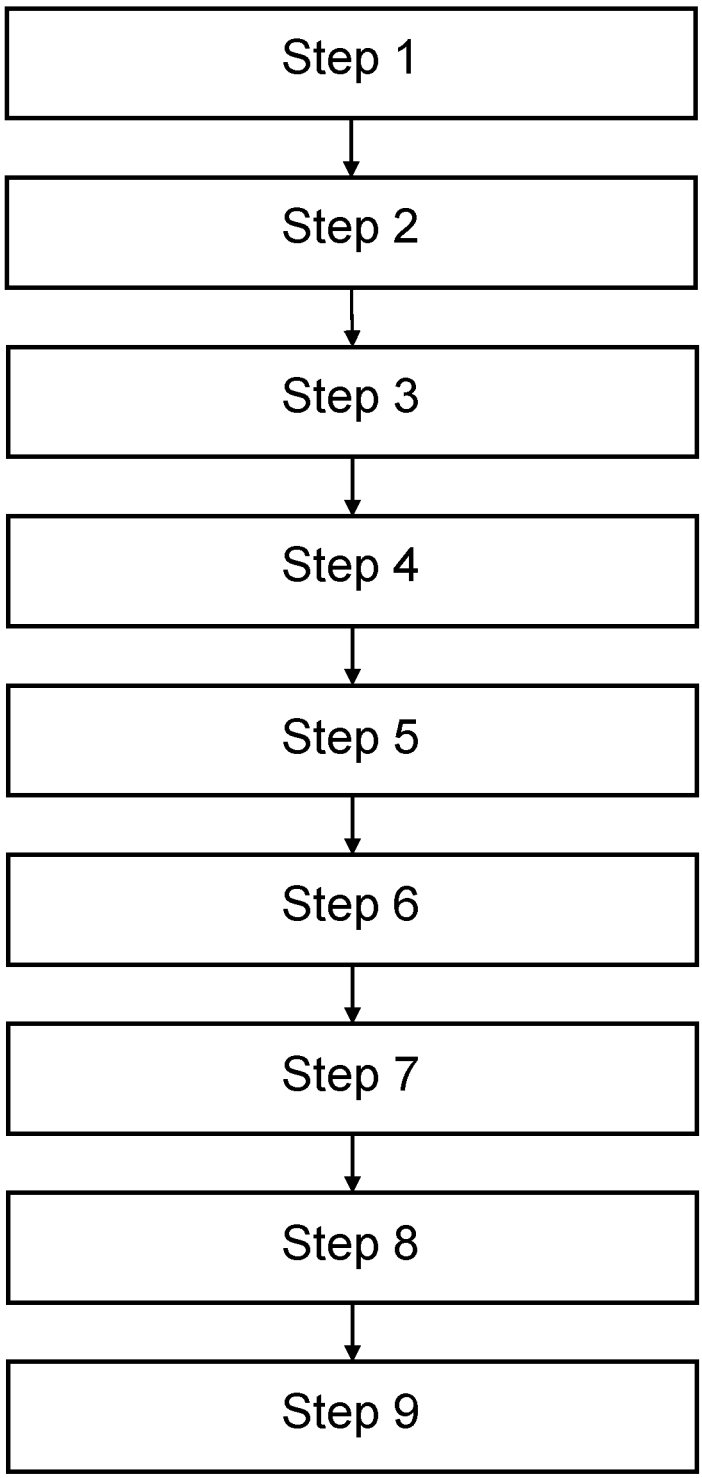
FIG. 9 shows steps taken when using a bag storage assembly according to exemplary embodiments hereof.

In some embodiments, the assembly 10 is used to hold and store a plurality of recyclable plastic shopping bags 500. In one example of this as shown in FIG. 9, the following steps may be followed while using the assembly 10:

1. Place the point $P_1$ of the first portion 404 into the inner volume 506 of a first recyclable plastic shopping bag 500, followed by the point $P_2$ of the second portion;
2. Rotate the assembly 10 downward so that the remainder of the bag flattening structure 402 is placed within the bag's inner volume 506;
3. Place a first bag's left handle 508 over the left portion 304 of the crossbar 302, and the first bag's right handle 510 over the right portion 306 of crossbar 302. Ensure that the left and right bag handles 508, 510 are held on the crossbar by the left and right stops 312, 314, respectively;
4. Place the point $P_1$ of the first portion 404 into the inner volume 506 of a second recyclable plastic shopping bag 500 (including the first bag 500), followed by the point $P_2$ of the second portion;
5. Rotate the assembly 10 downward so that the remainder of the bag flattening structure 402 (including the first bag 500) is placed within the bag's inner volume 506. This will result in the second bag 500 being held within the inner volume of the first bag 500;
6. Place a second bag's left handle 508 over the left portion 304 of the crossbar 302, and the second bag's right handle 510 over the right portion 306 of crossbar 302. Ensure that the left and right bag handles 508, 510 are held on the crossbar by the left and right stops 312, 314, respectively;
7. Repeat steps 1-6 for additional bags 500;
8. Using the attachment mechanism 202, hang the bag storage assembly 10 and the associated bags 500 onto a structure (e.g., a hook on the back of a door);
9. Remove the bag storage assembly 10 and associated bags 500 from the structure and deposit them (as a single unit) into a plastic bag recycling bin.

It is understood that the steps described above are meant for demonstration and that additional steps may be performed, not all of the described steps may be performed, and the steps may be taken in different orders. It also is understood that the scope of the assembly 10 is not limited in any way by the steps taken during its use.

It is understood that any aspect and/or element of any embodiment of the assembly 10 described herein or otherwise may be combined in any way to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on,"

and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A holder for storing at least one bag, the at least one bag including an inner volume with a bag width and at least one handle, the holder comprising:

a frame;

an attachment mechanism connected to the frame and adapted to attach the holder to a separate apparatus;

a bag handle holder attached to the frame, the bag handle holder including a crossbar including a crossbar first end and a crossbar second end and a crossbar body therebetween and adapted to hold said at least one handle of said at least one bag, the bag handle holder including at least one bag handle stop adapted to transition from a first position that holds said at least one handle to a second position that releases said at least one handle when at least a portion of a top of said crossbar body is rotated from an upward position to a downward position; and a bag body flattener attached to the frame and adapted to be received into said inner volume of said at least one bag;

wherein the bag body flattener is received into said inner volume of said at least one bag when said at least one handle of said at least one bag is held by the bag handle holder.

2. The holder of claim 1 wherein the frame includes an elongated member with a top end and a bottom end, and the attachment mechanism is attached to the elongated member's top end, the bag body flattener is attached to the elongated member's bottom end, and the bag handle holder is attached to the elongated member at an intermediary position between the top end and the bottom end.

3. The holder of claim 1 wherein the attachment mechanism includes at least one of a hook, a loop, and a clamp.

4. The holder of claim 1 further comprising a first at least one bag handle stop coupled to the crossbar first end and adapted to hold a first said at least one handle of said at least one bag, and a second at least one bag handle stop coupled to the crossbar second end and adapted to hold a second said at least one handle of said at least one bag.

5. The holder of claim 4 wherein the first at least one bag handle stop is configured to transition from a first handle stop upper position that holds the first said at least one handle to a first handle stop lower position that releases the first said at least one handle, and/or the second at least one bag handle stop is configured to transition from a second handle stop upper position that holds the second said at least one handle to a second handle stop lower position that releases the second said at least one handle.

6. The holder of claim 1 wherein the bag body flattener includes a bag body flattener width that is equal to or less than the bag width and greater than half the bag width.

7. The holder of claim 6 wherein the bag body flattener width includes a middle point and the frame is attached to the bag body flattener at a position adjacent the middle point.

8. A holder for storing at least one bag, the at least one bag including an inner volume with a bag width and at least one handle, the holder comprising:

an elongated member with a top end and a bottom end;

a hook, loop or clamp connected to the top end of the elongated member and adapted to attach the holder to a separate apparatus;

a crossbar with a crossbar first end and a crossbar second end and a crossbar body therebetween and attached to the elongated member at a position between the elongated member's top end and bottom end and adapted to hold said at least one handle of said at least one bag, the crossbar including at least one bag handle stop adapted to transition from a first position that holds said at least one handle to a second position that releases said at least one handle when at least a portion of a top of said crossbar body is rotated from an upward position to a downward position; and a bag body flattener attached to the bottom end of the elongated member and adapted to be received into said inner volume of said at least one bag;

wherein the bag body flattener is received into said inner volume of said at least one bag when said at least one handle of said at least one bag is held by the crossbar.

9. The holder of claim 8 comprising a first handle stop coupled to the crossbar first end and adapted to hold a first said at least one handle of said at least one bag, and a second handle stop coupled to the crossbar second end and adapted to hold a second said at least one handle of said at least one bag.

10. The holder of claim 9 wherein the first at least one bag handle stop is configured to transition from a first handle stop upper position that holds the first said at least one handle to a first handle stop lower position that releases the first said at least one handle, and/or the second at least one bag handle stop is configured to transition from a second handle stop upper position that holds the second said at least one handle to a second handle stop lower position that releases the second said at least one handle.

11. The holder of claim 8 wherein the bag body flattener includes a bag body flattener width that is equal to or less than the bag width and greater than half the bag width.

12. The holder of claim 11 wherein the bag body flattener width includes a middle point and the elongated member is attached to the bag body flattener at a position adjacent the middle point.

13. A holder for storing at least one bag, the at least one bag including an inner volume and at least one handle, the holder comprising:

a frame;

an attachment mechanism connected to the frame and adapted to attach the holder to a separate apparatus;

a bag handle holder attached to the frame, the bag handle holder including a crossbar including a crossbar first end, a crossbar second end and a crossbar body therebetween and adapted to hold said at least one handle of said at least one bag, the bag handle holder including at least one bag handle stop adapted to transition from a first position that holds said at least one handle to a second position that releases said at least one handle when at least a portion of a top of said crossbar body is rotated from an upward position to a downward position; and a bag body flattener attached to the frame and adapted to be received into said inner volume of said at least one bag, the bag body flattener including a width and a width middle point, wherein the frame is attached to the bag body flattener at a position adjacent the middle point;

wherein the bag body flattener is received into said inner volume of said at least one bag when said at least one handle of said at least one bag is held by the bag handle holder.

14. The holder of claim 13 wherein the frame includes an elongated member with a top end and a bottom end, and the attachment mechanism is attached to the elongated member's top end, the bag body flattener is attached to the elongated member's bottom end, and the bag handle holder is attached to the elongated member at an intermediary position between the top end and the bottom end.

15. The holder of claim 13 wherein the attachment mechanism includes at least one of a hook, a loop, and a clamp.

16. The holder of claim 13 wherein the bag handle holder includes a crossbar including a crossbar first end and a crossbar second end.

17. The holder of claim 16 further comprising a first bag handle stop coupled to the crossbar first end and adapted to hold a first said at least one handle of said at least one bag, and/or a second bag handle stop coupled to the crossbar second end and adapted to hold a second said at least one handle of said at least one bag.

18. The holder of claim 17 wherein the first bag handle stop is adapted to transition from a first handle stop upper position that holds the first said at least one handle to a first handle stop lower position that releases the first said at least one handle, and/or the second bag handle stop is configured to transition from a second handle stop upper position that holds the second said at least one handle to a second handle stop lower position that releases the second said at least one handle.

* * * * *